US005375504A

United States Patent [19]

Bauer

[11] Patent Number: 5,375,504

[45] Date of Patent: Dec. 27, 1994

[54] AUGMENTED HYPERVELOCITY RAILGUN WITH SINGLE ENERGY SOURCE AND RAIL SEGMENTATION

[75] Inventor: David P. Bauer, Xenia, Ohio

[73] Assignee: The United States of America as represented by the Secretary of the Air Force, Washington, D.C.

[21] Appl. No.: 87,248

[22] Filed: Jul. 6, 1993

[51] Int. Cl.[5] ..... F41B 6/00

[52] U.S. Cl. ..... 89/8; 124/3

[58] Field of Search ..... 89/8; 124/3

[56] References Cited

U.S. PATENT DOCUMENTS

| | | | |
|---|---|---|---|
| 4,913,030 | 4/1990 | Reynolds | 89/8 |
| 4,938,113 | 7/1990 | Kemeny et al. | 89/8 |
| 5,127,308 | 7/1992 | Thompson et al. | 89/8 |
| 5,138,929 | 8/1992 | Weldon et al. | 89/8 |
| 5,168,118 | 12/1992 | Schroeder | 89/8 |
| 5,173,568 | 12/1992 | Parmer | 89/8 |
| 5,183,957 | 2/1993 | Weldon et al. | 89/8 |

OTHER PUBLICATIONS

Mannix et al, Proceedings of the Second Hypervelocity and Impact Effects Symposium, vol. I, Dec. 1957, pp. 133-134 and 137.

*Primary Examiner*—Stephen C. Bentley

*Attorney, Agent, or Firm*—Gerald B. Hollins; Thomas L. Kundert

[57] ABSTRACT

An electromagnetically energized railgun system in which nesting and segmenting of the primary rails is combined with augmenting rails and crossover bar conductors and an inductorless single power supply arrangement to provide a high efficiency hypervelocity capable railgun improvement over prior railgun arrangements. The disclosed railgun apparatus uses a single power supply or energy source and achieves the desired near zero muzzle energy storage through a combination of inductive and resistive primary rail commutation, power supply pulsing, and augmenting rail inductive energy storage.

9 Claims, 10 Drawing Sheets

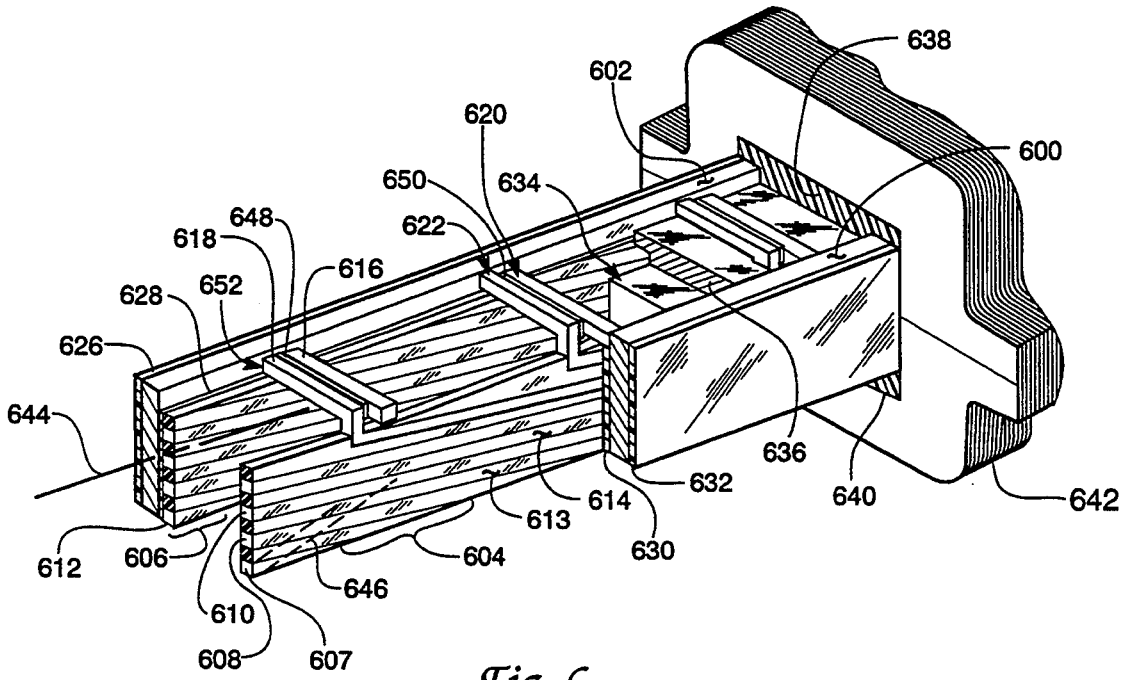
Fig. 6
Fig. 7
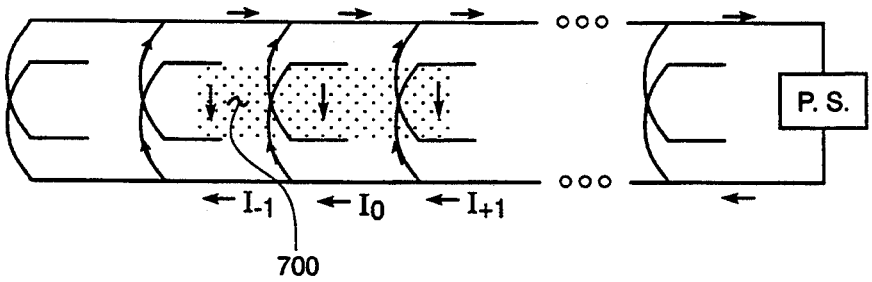
Fig. 8
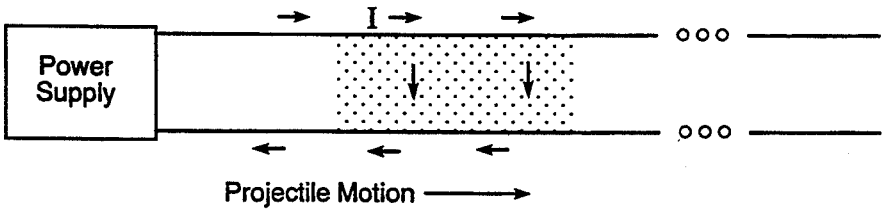
Fig. 9
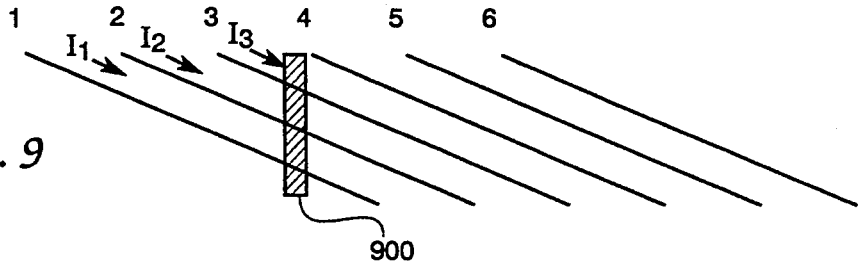

AUGMENTED HYPERVELOCITY RAILGUN WITH SINGLE ENERGY SOURCE AND RAIL SEGMENTATION

RIGHTS OF THE GOVERNMENT

The invention described herein may be manufactured and used by or for the Government of the United States for all governmental purposes without the payment of any royalty.

BACKGROUND OF THE INVENTION

This invention relates to the field of electromagnetically energized railguns and especially to hypervelocity high efficiency versions thereof.

Conventional chemical reactant or gun powder energized guns are considered to have an upper limit of muzzle velocity. One approach to achieving higher projectile velocities that are in excess of currently used values involves the use of the electromagnetically energized railgun. In order to achieve these higher velocity performances, however, railgun rail currents in the range of 250 kiloamperes to 4,000 kiloamperes (ka) are considered necessary along with energy storage arrangements measuring in the megajoule range.

Electromagnetic railguns are now considered for several defense and non-defense projectile launch applications which include earth-to-space launch transportation, hypervelocity aerothermodynamic investigations, lethality investigations and equation-of-state materials testing. These diverse applications translate to a broad range of railgun performance requirement, in which additional factors such as boresize, muzzle energy level, launch velocity, fire rate, barrel life, and systems size to mass ratio are a few of the additional salient characteristics to be considered.

Recent advances in the railgun art include barrels of lightweight and relatively stiff design, improved power supplies and energy switching arrangements, improved armature or projectile configurations, enhanced barrel materials, and low mass high "G" tolerant projectile packages. Functioning railgun embodiments employing plural of these advances in the art have been fabricated or are now being fabricated throughout the free world.

Notwithstanding these recent improvements in the railgun art, additional improvement is needed in at least four areas generally recognized as limitations to large scale usage of such apparatus. These improvements are especially needed in the areas of compact power supplies, improved rail life expectancy, hypervelocity projectile capabilities (velocities in the order of ten kilometers per second), and improved electrical energy to kinetic energy transformation efficiencies—efficiencies greater than 40%. The later two of these improvement areas are particularly addressed in the present invention.

The patent art includes several examples of railgun apparatus that is of general background interest with respect to the present state of the railgun art and the present invention. Included in these patents is the U.S. Pat. No. 4,938,113 of G. A. Kemeny et al which is concerned with an electromagnetic projectile launcher having reduced muzzle arcing. This arcing improvement is achieved through the use of a capacitor bank and lightning arrestor circuit which contribute to a current reversal sequence in the rails of the described railgun. Since the Kemeny apparatus does not include a nested primary rail portion, a ready distinction between the present invention and the Kemeny apparatus is apparent.

Another of these patents of background interest is U.S. Pat. No. 5,138,929 issued to W. F. Weldon et al. The Weldon et al patent contemplates the use of current guard plates surrounding the rails of a railgun in order to shape the railgun current waveforms into a more favorable distribution on the rails. In the Weldon apparatus the current flow in the surrounding guard plates interacts with rail currents to force a more uniform distribution of current across the entire rail surface and to thereby reduce peak current densities at the inside rail corners where heating is a problem. Since the Weldon et al apparatus does not contemplate the use of a segmented primary rail, a ready distinction with the present invention is apparent.

The patents of general interest also include U.S. Pat. No. 5,168,118 issued to J. M. Schroeder and concerned with the use of plural magnetic rings along a projectile accelerating barrel. In the Schroeder apparatus the natural or ringing frequency of the electrical current flowing in the coils of these magnetic rings is carefully adjusted to suit the velocity of the projectile being accelerated. Since the Schroeder apparatus employs discrete coils rather than the segmented rail and augmenting rail structures of the present invention a ready distinction for the present invention is discernible.

Also included in this art of general interest is U.S. Pat. No. 5,173,568 issued to J. F. Parmer and concerned with a magnetic gun apparatus in which superconducting dipoles are used to exclude certain magnetic fields from entering the gunbore. Since the Parmer apparatus does not include the segmented and nested rails of the present invention and since it also involves the use of superconducting elements, a number of distinctions exist between the present invention and the Parmer apparatus.

Additionally included in this patent art is U.S. Pat. No. 5,183,957 issued to W. F. Welden et al and concerned with an arrangement for controlling the distribution of current in the armature of a railgun by way of providing a low conductivity material dispersed along the rails. This material is preferably in the form of graphite or a graphite and copper mixture. Since the Welden et al '957 patent is also not concerned with segmented rails or augmenting rails a ready distinction is present with respect to the present invention.

Also of general background interest with respect to the present invention is the technical paper published by J. S. Kerrisk and titled "Current Distribution and Inductance For Rail-Gun-Conductors", LA-9092-MS, Los Alamos National Laboratory, November 1981. The Kerrisk paper is limited to a disclosure of current diffusion and inductance computations and therefore is of background and limited interest with respect to the combination invention herein disclosed. The Kerrisk paper is, however, incorporated by reference herein.

SUMMARY OF THE INVENTION

A combination of segmented primary rails, employed augmenting rails, a single source of electrical energy, and nesting of the primary rail segments is employed to achieve a hypervelocity railgun of improved operating efficiency and other desirable operating characteristics—including the presence of near zero rail energy at the instant of armature projectile launch from the barrel in the prsent invention.

It is therefore an object of the present invention to provide a hypervelocity railgun apparatus.

It is another object of the invention to provide a railgun apparatus of improved operating efficiency.

It is another object of the invention to provide a railgun apparatus in which the primary rails are configured in a nested and segmented plurality of subrails arrangement.

It is another object of the invention to provide a railgun apparatus wherein the need for external conductive elements is overcome through the use of inherent inductance elements present in the already-provided rail system.

It is another object of the invention to provide a railgun apparatus in which nesting of the main or primary rails is accomplished in combination with the use of a single electrical energy source for the apparatus It is another object of the invention to provide a nested primary railgun apparatus in which a combination of ohmic resistance and mutual inductance coupling is used to provide a rail segment current control mechanism.

It is another object of the invention to provide a railgun apparatus in which a set of augmenting rails provide both increased acceleration forces for an armature projectile and also provide energy storage without the use of the usual discrete inductive elements.

Additional objects and features of the invention will be understood from the following description and claims and the accompanying drawings.

These and other objects of the invention are achieved by single energy source augmented rail gun apparatus comprising the combination of:

first and second nested arrays of projectile guiding, projectile accelerating, electrically conductive, primary rail segments disposed in diametric opposition along a central axis of the apparatus and defining a gun barrel portion thereof, with each segment of each said array residing in both a first plane of parallel disposition with said central axis and in an orthogonal second plane of oblique angle disposition with said central axis, and with each segment of each said array also being electrically isolated, but magnetically coupled with substantially adjacent additional segments of said arrays, a plurality of electrically conductive augumenting rail members each disposed lengthwise parallel of said central axis and adjacent an external surface of a primary rail segment nested array in electrical isolation and magnetic coupling therewith;

a plurality of primary rail segment to augmentation rail electrical interconnection bar members crosswise disposed along said central axis in physical displacement therefrom and interconnecting an electrical input terminal end portion of each rail segment with an opposite augmentation rail member;

with each combination of a primary rail segment, an interconnection bar member, and an augmenting rail member portion also comprising electrical energy storing electrical inductance means, equivalent with an external discrete electrical inductance member, for storing projectile acceleration energy in electrical form;

a movable ballistic projectile member initially disposed between breech end boundaries of said first and second primary rail segments and movable along said primary rail segments and said central axis in response to electrical energy current flow in said augmenting rail members and multiple segment successions of said primary rail segments; and single output port electrical energy sourcing means selectably connected between gun barrel muzzle terminal ends of said augmenting rail members for generating magnetically linked electrical currents responsive to gun barrel positioning of said projectile member in said primary rail segments and in said augmentation rail members.

BRIEF DESCRIPTION OF THE DRAWINGS

FIG. 6 shows a railgun apparatus according to the invention in cutaway perspective forms.

FIG. 7 shows current flow in a railgun of the present invention type.

FIG. 8 shows current flow in a conventional railgun arrangement.

FIG. 9 shows a representation of current flow in multiple segments of the present invention rail segments.

DETAILED DESCRIPTION

Railgun efficiency, the ratio of launch package muzzle kinetic energy to initial stored electrical energy is predicted to be in the 20 to 40 percent range for most railgun applications. However, the highest reported actual performance efficiencies are about 30 percent. These relatively low efficiencies mean that a railgun power supply must generate from 2.5 to 5 times the projectile or armature-required kinetic energy. To compound this efficiency problem, most of the wasted energy in a railgun is dissipated ohmically and must be removed from the conductors by a thermal management system. Low railgun efficiency therefore, usually leads to sizable power supplies and large thermal management systems.

Figure 1:
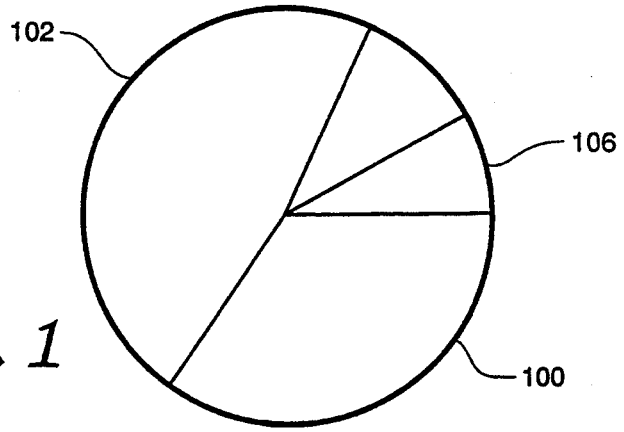
FIG. 1 shows an energy usage or efficiency diagram for certain railgun usage.

Much of the wasted energy in a railgun shot occurs in energy transferred from the power supply and stored as magnetic flux in the railgun barrel at projectile launch. This magnetic flux energy is difficult to recover, and usually ends up being dissipated ohmically in the rails and electrical power supply. FIG. 1 is a pie chart depicting energy partitioning for a typical high energy hypervelocity launch with the kinetic energy indicated at 102. The barrel magnetic energy loss at 100 is clearly larger than the rail resistive losses at 106 in this example and is in fact the dominant loss mechanism in the FIG. 1 launch. Significantly higher efficiency performance is clearly possible if railgun magnetic energy losses can be reduced.

Figure 2A:
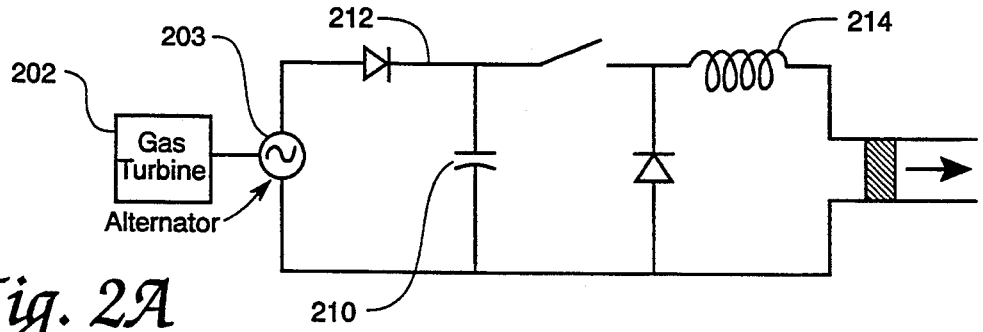
FIG. 2A shows a typical alternator energized railgun circuit.
Figure 2B:
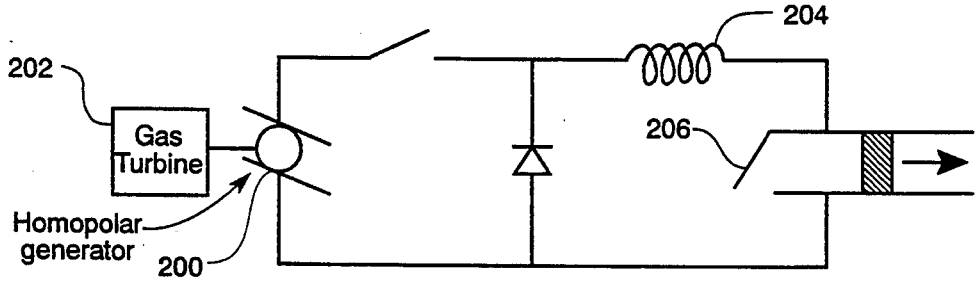
FIG. 2B shows a homopolar generator energized railgun.

To better understand the present invention, it is helpful to consider that most mobile applications of railguns require a chemical to electrical power conversion or generation system and electrical power conditioning components. Two alternative railgun power system circuits are in fact shown in FIG. 2A and 2B herein. A likely power conversion scheme may employ a gas turbine, 202, driving an electrical generator such as a homopolar generator 200 or an alternator 203. The power conditioning network for a turbine-homopolar generator may consist of an inductor 204 and an opening switch 206. The inductor 204 is sized to store at least the energy for a single railgun shot.

One power conditioning option for a turbine-driven alternator 202–203 includes rectifier 212 and capacitors 210, along with a pulse forming inductor 214. In this approach, the capacitor 210 and the inductor 214 must store the total required launch energy. Approaches such as described herein which eliminate some of these power components and reduce the power system size to mass ratio are obviously desirable. Clearly, railgun inefficiency exacerbates power system size and mass.

Figure 3:
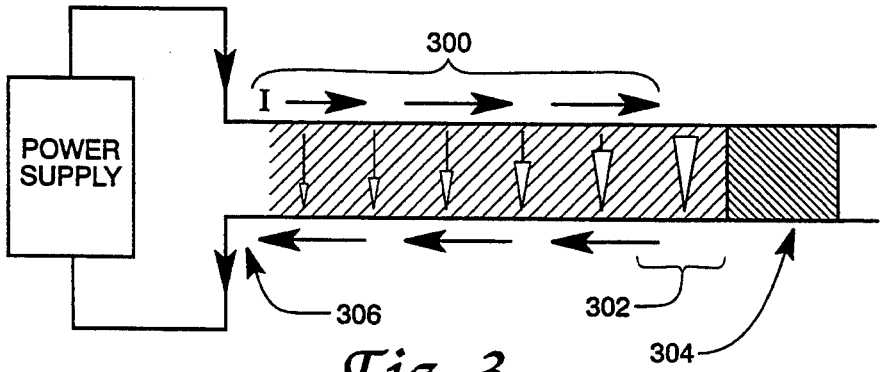
FIG. 3 shows the phenomenon of secondary current paths in a railgun launch event.

Projectiles that are accelerated by plasma and hybrid armatures in railguns, as is shown in FIG. 3 herein, reach a "velocity limit" at about 6 km/s. Above about 4 km/s, the predicted and actual velocity differ so that near 6 km/s, no amount of current or barrel length provides significantly higher velocities. The primary reasons for this limit are the development of secondary current paths or arcs behind the main armature, and separation of the plasma armature from the projectile. The secondary current path phenomenon is illustrated at 300 in FIG. 3. The arrow sizes in the FIG. 3 drawing indicate the general nature of a typical secondary current path experience. As the FIG. 3 plasma armature 302 is formed, it expands and "leaks" highly ionized plasma into the bore behind the projectile. Plasma far behind the projectile is in fact usually ionized and therefore capable of conducting current. As the projectile 304 increases in speed, rail-to-rail voltage behind the projectile increases proportionately. The highest voltage is at the breach 306, for the normal railgun configuration shown in FIG. 3. When this voltage is high enough, secondary current begins to flow in the residual plasma remaining behind the armature 302. These secondary currents rob current from the armature, reducing the accelerating force applied to the projectile. Improved efficiency including minimal FIG. 3 plasma conduction and repeatability of launches at velocities exceeding 6 km/s are however, essential to make railguns viable candidates for some missions.

FIG. 6 in the drawings shows a cutaway perspective view of an improved railgun apparatus according to the present invention. The FIG. 6 railgun addresses the questions of railgun efficiency, power supply size, and lack of hypervelocity, questions which hamper wider acceptance of railguns for many potential mission applications. The FIG. 6 railgun of the present invention is also shown in diagramatic form in FIG. 4 of the drawings.

The FIG. 6 arrangement of the present invention railgun consists of a pair of augmenting conductors 600 and 602 located alongside (and outside of) a pair of nested, segmented primary or main rails 604 and 606. The nested, segmented main rails 604 and 606 are actually comprised of many conducting segments 607, 608, 610 and 612 each often less than 100 centimeters long, which are embedded between the insulator segments shown typically at 613 and 614. Multiple current crossover bars, located in pairs along the length of the gun as shown at 616, 618, 620 and 622, connect the segmented rails to the augmenting rails. Each nested, segmented primary rail 604 and 606 is connected through these current crossovers to the augmenting rail situated on the opposite side of the gun, thus obtaining an augmenting magnetic field effect which adds acceleration force to a launched projectile. This augmenting field is also useful in the present invention railgun for storing projectile launch energy in the form of magnetic flux as is described below.

Additionally shown in the FIG. 6 cutaway perspective view of a railgun according to the present invention are the insulation layers 626, 628, 630 and 632 for the augmenting rails 600 and 602, the movable or accelerable armature projectile 634, the insulation layer 636 for the crossover bars 616–622, and the top and bottom insulating layers 638 and 640 for the primary and augmenting rails. Also shown in FIG. 6 is the laminated iron support structure 642 which is used to retain elements of the FIG. 6 railgun in the indicated relative positions notwithstanding the large disintegrating forces generated during projectile launch. Lamination of the ferrous material in the surrounding support structure 642 is desirable to minimize eddy current losses during projectile launch energization of the FIG. 6 apparatus.

As shown in FIG. 6, each primary rail segment such as the segments 607 and 608 is disposed in a generally forward and downward sloping direction and at an oblique or acute angle with respect to a horizontal plane passing through the central axis 644 of the illustrated railgun. Generally acute angles of between zero and 40 degrees in size are plausible for the disposition of these conductor segments with respect to the central axis horizontal plane. A preferred angle of 10 degrees provides several segments in contact with the armature simultaneously. Generally small angles and thin conductor segments are desirable with the conductor segment thickness also being influenced by the bore size used.

Energization current for the FIG. 6 railgun is applied at terminals located at the right-most extremity or muzzle end of the augmenting rails 600 and 602. Augmenting rail current and primary rail current therefore flow in opposite directions in adjacent rail members of the FIG. 6 structure. The physical forces resulting from these currents tend to subject the rail insulation layers 628 and 630 to compressive forces. A similar condition exists between adjacent crossover bars 616, 618 and 620, 622 where the crossover bar insulating layers are also placed in physical compression as a result of the high electrical current flowing during a launch event. Electrical connection of the crossover bar members with the augmenting rails as occurs at the 652, for the cross-over bar 618 and the augmenting conductor 602, is preferably accomplished by welding, brazing, or tab bending techniques in the FIG. 6 railgun.

An alternate arrangement of the segmented and nested primary rail conductors shown in FIG. 6 is represented by the dotted lines at 646. These dotted lines indicate the plausible shaping of the primary or main rail segment 610 in the form of a Chevron rather than in the straight line configuration shown in FIG. 6. For certain uses of the FIG. 6 rail gun apparatus as for example, very high velocity launch events, this Chevron configuration of rail segments offers the advantage of symmetric current feed to the armature, thereby creating symmetric armature forces exclusive of a net downward force component.

The concept of nested Chevron rails has in fact been proposed by one Richard A. Marshall in the technical paper titled: "The Use of Nested Chevron Rails in a Distributed Energy Store Railgun" which appears in the IEEE Transactions on Magnetics, Volume MAG-20, number 2, March 1984. The Marshall article is hereby incorporated by reference herein.

The FIG. 6 nested, and segmented main rails are therefore fabricated with multiple small conductors embedded between insulator segments. Each conductor segment may have a relatively small cross-section because of the brief duration it is in contact with the armature and hence its short current conduction time. The augmenting conductors 600 and 602 in FIG. 6 are, however, provided with the illustrated large cross section in order to minimize ohmic losses. Crossover connections are arranged to allow convenient hookup during railgun barrel assembly. The insulator covering the crossovers is also arranged to withstand the axial magnetic forces tending to launch the crossovers.

Figure 4A:
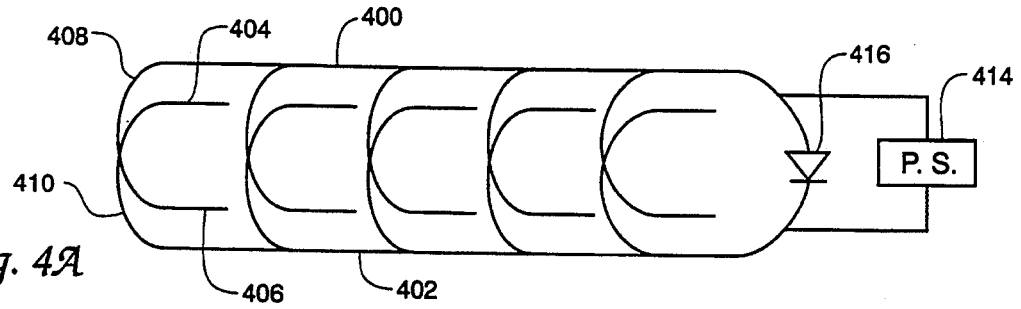
FIG. 4A shows a railgun according to the present invention in diagrammatic form.

FIGS. 4A, 4B, 4C and 4D in the drawings show a railgun apparatus of the type illustrated in FIG. 6 in diagrammatic form and during four differing phases of a projectile launch event. In the FIG. 4A drawing the augmenting rails are shown at 400 and 402, the individual rail segments at 404 and 406, and the crossover interconnections between augmenting rails and rail segments are indicated at 408 and 410. The armature projectile being accelerated in the FIGS. 4A–4D rail gun sequence is indicated at 412 in FIG. 4B, FIG. 4C, and FIG. 4D. A power supply or source of energy such as a charged capacitor is indicated at 414 in FIG. 4A and an electrical diode element which conducts for example during a collapse of magnetic fields attending the rails in FIG. 4A is indicated at 416 in FIG. 4A.

Figure 4B:
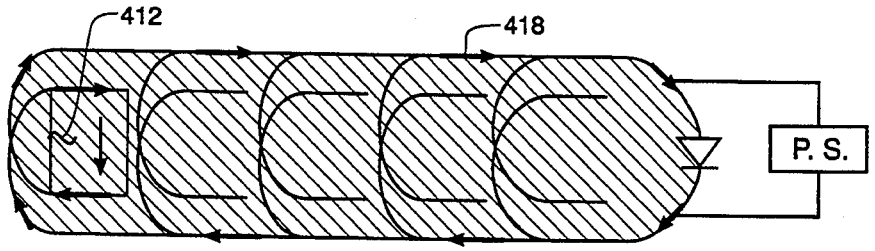
FIG. 4B shows magnetic flux energy storage in the FIG. 4A railgun at the beginning of a projectile launch event.

Initially, a power supply (for example a capacitor bank) connected to the muzzle end of the augmenting rails is discharged into the FIG. 4 railgun, with a projectile and armature located at the breech (as depicted in FIG. 4B). During capacitor discharge, energy is transferred and stored in the augmenting turn with the current path being completed within the railgun by the armature. The armature "short circuits" the current path as it moves down the barrel and contacts the second main rail segment. Current is then shared between the rail segments as it begins to flow into the second segment. Current sharing occurs with more segments as the armature contacts, and short circuits these segments (as depicted in FIG. 4C). As each new segment becomes active, less current flows in the previous segments due to lower impedance of the path through the segments closest to the armature. Between six and eight rail segments will be actively carrying current to the armature except at the breech and muzzle. As the armature moves past a segment, current will completely commutate out of that segment and into those in contact with the armature. Close mutual magnetic coupling between rail segments results in very low energy dissipation as each rail segment is disconnected from the armature and de-energized. The armature may of course be of a current conducting nature or of a non-current conducting nature and thereby dependent upon an electric arc formed behind the armature for propulsin of the armature. In the arc propelled armature an arc-resistant surface may be provided on the armature's back side.

Energy stored in the magnetic field (represented by the shaded region in FIGS. 4B, 4C, and 4D) of the augmenting turn/energy store drives the current and hence accelerates the projectile. As the projectile accelerates along the barrel, part of the electrical circuit is "removed" as each rail segment is de-energized. Augmenter inductance decreases as the projectile moves along the barrel, tending to keep the current constant. When the projectile exits the muzzle, only the final rail segment is energized, limiting the residual stored energy to a very small quantity.

The FIG. 4A through FIG. 4D series of drawings therefore shows energy storage aspects of the present invention railgun apparatus during the launching of a projectile armature member. In the FIG. 4A drawing, energization from the power supply 414 has not yet occurred while in FIG. 4B this energization or application of current has occurred as is indicated by the current flow arrows 418. Energy from the power supply 414 is initially discharged into the augmenting turn inductance in the FIG. 4B drawing with the shading indicating where this energy is stored.

Figure 4C:
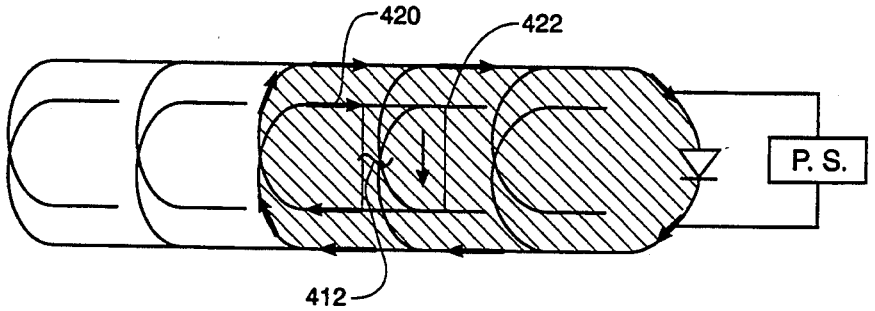
FIG. 4C shows the magnetic flux energy storage condition at a mid gun barrel position of the projectile being launched.
Figure 4D:
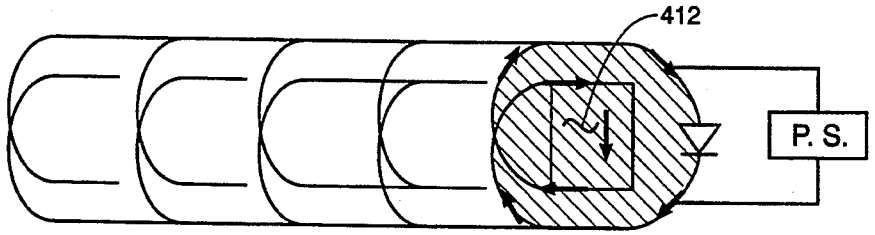
FIG. 4D shows the magnetic flux energy storage condition just prior to projectile emergence from the muzzle end of the gun barrel.
Figure 5:
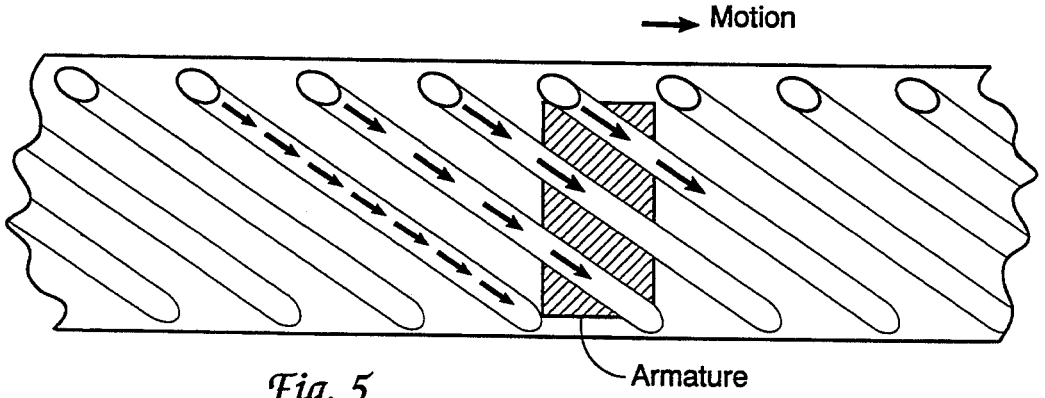
FIG. 5 shows current division between nested segments of a primary rail in the FIG. 4 and FIG. 6 present invention gun barrel during projectile movement.

As the armature projectile 412 travels along the gun barrel in FIG. 4, current is supplied to the armature projectile by more than one primary rail segment as is indicated in FIG. 4C—where the adjacent segments 420 and 422 are concurrently active. Current division between the segments 420 and 422 is in accordance with the armature projectile to segment contact arrangement illustrated in FIG. 5 and is, of course, dependent on armature projectile position with respect to segment location along the gun barrel. The sizes of the arrows in the FIG. 5 drawing indicate the relative current amplitude in the FIG. 5 illustrated segments. As is indicated by absence of shading in the initial portion of the gun barrel in FIG. 4C no energy remains in the inactive segments located behind the moving armature projectile in the FIG. 4 sequence. As is indicated in FIG. 4D the gun barrel portion accomplishing magnetic energy storage is small as the armature projectile approaches the gun muzzle. As the projectile exits the barrel, there is very little residual energy remaining in the barrel to cause the commonly experienced, but undesirable flashover arc at the barrel's muzzle end.

MATHEMATICAL CHARACTERIZATION—ELECTRICAL

During operation of the present invention railgun, current flows from the muzzle, through the augmenting rails, through the current crossovers, and into the rail segments active at a given instant. As the armature traverses the bore it will "switch" on and off the leading and trailing segments respectively as shown in FIGS. 5 and 7 of the drawings. Residual magnetic energy—when the armature 700 in FIG. 7 loses contact with the rails of a segment, will tend to abruptly commutate with energy dissipation in the form of an arc. The best method for preventing this, is high mutual coupling between segments. This results in low energy dissipation due to an efficient transfer of energy between segments.

A main goal of a mathematical characterization of the present invention is to determine the conditions needed for low loss segment-to-segment current transfer. A characterization of the behavior of the current in a typical segment during the time in which it is active, however, requires a characterization of a sufficiently long section of barrel to minimally include all active segments at any instant in time.

In order to enable an appreciation of a mathematical characterization for the present invention an electrical characterization for a conventional railgun is first considered. This configuration, as shown in FIG. 8, consists of two parallel conductors with the power supply located at the breech. The voltage looking into the breech is represented by the equation:

$$Vb = L'x(dI/dt) + L'(dx/dt)I + IR'x + V_{arm} \quad (1)$$

where

I=current in the rails,

L'=gun inductance gradient,

R'=rail resistance gradient, x=position of the armature from the breach, and $V_{arm}$=voltage drop across the armature.

There are two inductive terms in this equation, the first on the right describes the voltage induced by changing current in the railgun inductance. The second inductive term is the voltage necessary to establish magnetic flux in a "new" part of the railgun.

The present invention railgun can be considered in a manner similar to the FIG. 7 simple railgun. Each present invention segment has the basic electrical characteristics of the gun described above, with additional induced voltages due to the inductive coupling between segments. The segment voltage in the $j^{th}$ segment for a configuration containing n segments would be:

$$\begin{aligned} V = {} & L'_j x(dI_j/dt) + L'_j(dx/dt)I_j + I_j R'_j x + \\ & M'_{jj+1}x(dI_{j+1}/dt) + M'_{jj+2}x(dI_{j+2}/dt) + \\ & M'_{jj+1}(dx/dt)I_{j+1} + M'_{jj+2}(dx/dt)I_{j+2} + \\ & M'_{jj-1}x(dI_{j-1}) + M'_{jj-2}x(dI_{j-2}/dt) + \\ & M'_{jj-1}(dx/dt)I_{j-1} + M'_{jj-2}(dx/dt)I_{j-2} + V_{arm} \end{aligned} \quad (2)$$

where $I_j$=current in the $j^{th}$ segment, $L'_j$=inductance gradient of the segment, $R'_j$=resistance gradient of the segment, $M_{ab}$=mutual inductance gradient between the $a^{th}$ and $b^{th}$ segments, x=position, along the segment, of the armature from the start of the segment, and $V_{arm}$=voltage drop across the armature.

This equation actually contains (n−1) induced voltages due to the M' x (dI/dt) terms and (n−1) induced voltages as a result of the M' (dx/dt) I terms. The physical meaning of the two types of mutual inductive terms is similar to the inductive terms for the sample railgun. There are also induced voltages due to the current in the augmenter, which will be considered later. The addition to the characterizing complexity because of the intersegment inductive coupling is obvious, as Equation (2) indicates.

The present invention railgun can be characterized electrically as a set of time varying lumped parameters listed below.

- Resistance of each segment.
- Inductance of each segment.
- Resistance of the augmenter.
- Inductance of the augmenter.
- Mutual inductance between each segment and adjacent segments.
- Mutual inductance between each segment and the augmenter.
- Resistance of the current crossovers.
- Inductance of the current crossovers.
- Mutual inductance between each segment and adjacent current crossovers.
- Mutual inductance between each current crossover and the augmenter.

In this characterizing the last four parameters in this list are ignored by assuming they are relatively small.

With the basic physics/mathematics thusly outlined, the method by which the railgun is characterized is chosen based primarily on ease of implementation while achieving the aforementioned goals. In order to characterize the longest section of the gun possible, simulation in an electronic circuit analysis package is preferred since time varying parameters (i.e., inductances, etc.) are there realized in a convenient manner.

The highly magnetically coupled nature of the present invention railgun results in a highly coupled mathematical model for the railgun. The size of the matrix required for simultaneous solution of the set of resulting equations often constrains the number of rail segments that can be considered and imposes three restrictions. The first is the inability to characterize the inductive coupling between each segment and the augmenter. It is difficult to determine the magnitude of the effect of this coupling but the actual railgun performance is better than the presently disclosed predictions. The second constraint is on the number of concurrently active segments that can be considered. The number of concurrently active segments is primarily a function of the segment inclination, spacing and length. The third constraint is the fact that only a short section of the gun is characterized. This requires forcing current to zero in a segment in order to examine a steady-state response.

FIG. 9 of the drawings is a view, normal to the bore and central axis, showing six segments of the present invention railgun and the armature. The infinitely thin armature 900 is considered here just as it is about to contact the fourth segment and is moving at a constant velocity. At any given instant it is in contact with three segments which are referred-to as the leading, middle, and trailing segments. The leading segment is the segment in contact for the shortest amount of time while the trailing segment has been in contact for the longest time. Inductive coupling is considered for all active segments at every instant. This coupling is determined based on a physically realizable, baseline gun geometry as described parametrically in Table 1. The gun is assumed to be driven by a constant current source.

TABLE 1

| PARAMETERS IN RAILGUN MODEL | |
|---|---|
| Boresize | 20 mm |
| Total Current | 500 kA |
| Segment Length | 250 mm |
| Segment Pitch | 80 mm |
| No. of Simultaneously Active Segments | 3 |
| Effective Self Inductance Gradient | 1 μH/m |
| Mutual Inductance Gradient 1-2 | 0.85 μH/m |
| Mutual Inductance Gradient 1-3 | 0.55 μH/m |
| Effective Coupling Coefficient | 0.55 |

Figure 10:
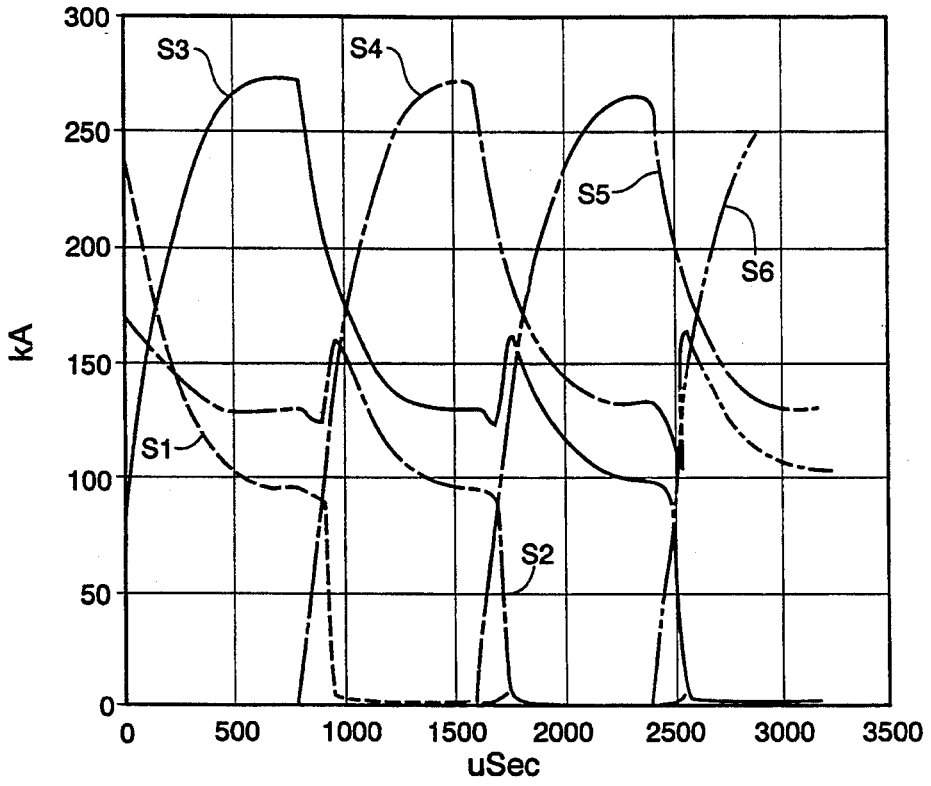
FIG. 10 shows current partitioning among active segments in a railgun of the present invention type.

Current partitioning among active segments is the main independent parameter evaluated. FIG. 10 shows active segment currents as a function of time. At time zero in FIG. 10, three segments $S_1$, $S_2$, $S_3$ are active as shown in FIG. 9. The armature is moving at 100 meters/second (m/s) and is 66% along the length of segment 1, $S_1$; 29% along the length of segment 2, $S_2$; and 5% along the length of segment 3, $S_3$. The segment currents at this time are 240 kA, 170 kA, and 80 kA respectively. As time progresses from zero, segment 1 and segment 2 currents decay while segment 3 current rises. At about 800 μsec the armature begins contacting segment 4 and simultaneously departs from segment 1. Current rises rapidly in segment 4 and decays rapidly in segment 1. A transient increase is also induced in segment 2 at about 900 μsec. The cycle of current rise and fall is then repeated in each stage as the armature travels along the gun.

Figure 11:
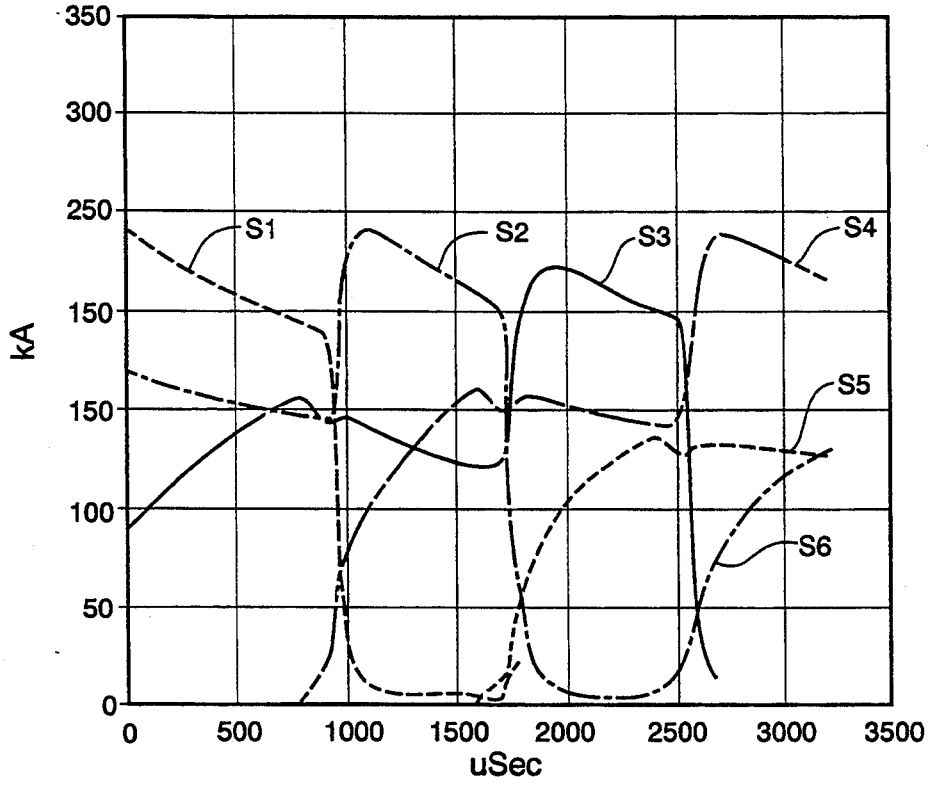
FIG. 11 shows current partitioning in a railgun of the present invention type at a greater armature velocity.

The current distribution among the active segments is found to be somewhat dependent upon armature velocity. FIG. 11 illustrates the currents at 1000 m/s. At higher velocities, the current tends to be higher in the trailing segments whereas at low velocities, the current is higher in the leading segment. This is notable and is very close to the desired behavior in that, by the time at which a segment becomes inactive, its current and therefore energy storage have decreased dramatically.

Figure 12:
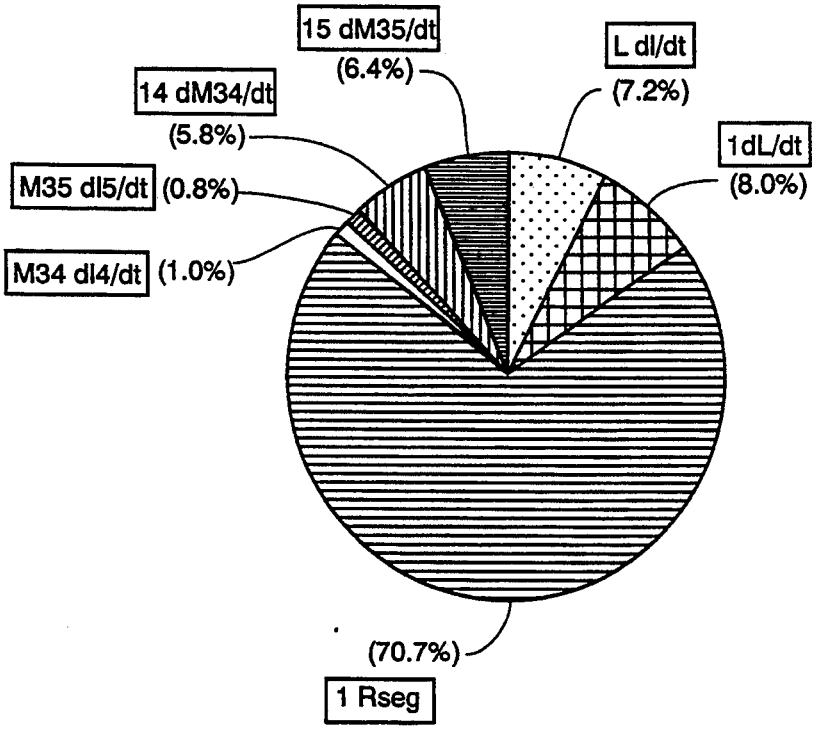
FIG. 12 shows the partitioning of voltages in a FIG. 10 type low velocity railgun.
Figure 13:
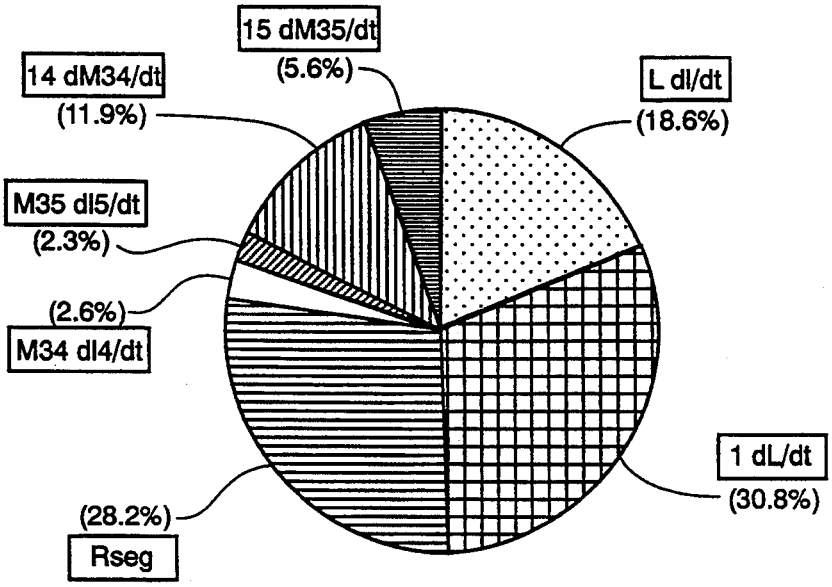
FIG. 13 shows the partitioning of voltages in a FIG. 11 type higher velocity railgun launch.

Referring back to the components of segment voltage identified above there are two types of terms dependent upon velocity, the M' (dx/dt) I terms and the L' (dx/dt) I term. These are the speed voltages for the self and mutual inductances. The effective resistances presented by these terms is a function of velocity. FIGS. 12 and 13 display the voltage components in segment 3 as a percentage of the total segment, for the 100 m/s and 1000 m/s cases respectively, when the projectile is about 88% of the length along segment 3. These graphs represent typical voltage distributions in a trailing segment prior to commutation. In the low velocity case, the speed voltages account for less than 20% of the effective segment impedance, while in the high velocity case they account for almost 50% of the effective segment impedance. With increasing velocity the resistances presented by these terms become greater. When a segment initially becomes active, its current is determined by its effective impedance relative to the other active segments. At this time the self inductance and resistance of the segment are small and increase with time whereas the velocity dependent terms are constant and account for nearly all of the segment impedance. The higher the velocity the greater the initial impedance of a segment. Higher segment mutual coupling is required to obtain better current partitioning at higher velocity.

There are three possible avenues for controlling these velocity effects.

(1) Reducing inductive gradients.

(2) Increasing impedance of the trailing and middle segments.

(3) Decreasing segment inclination.

The first two of these controls require definite tradeoffs. Reducing the gradients associated with the mutual coupling also decreases the intersegment energy transfer. Assuming the self inductance gradients of the segments can be changed without an effect on gun geometry, the accelerating force also decreases by a proportional amount. Increasing the impedance of the segments by using a high resistivity material for the segments has a detrimental effect on overall efficiency. However, use of tailored resistance (i.e., segment resistivity increased or cross sectional area decreased toward the end of the segment) provides a good compromise between efficiency and better intersegment current transfer.

The speed voltages within the segment are determined by the gradients and the velocity along the segment. This velocity is related to the armature velocity by a factor of, $$1/\cos(\theta) \tag{3}$$

where $\theta$ is the segment inclination. The lower the inclination, the closer the velocity along the segment is to the armature velocity. High inclination angles result in higher speed voltage because the "effective" velocity is higher.

Considering the above results, three guidelines can be stated.

(1) High segment transit time is preferred.

(2) High intersegment mutual coupling is preferred.

(3) High current partitioning among active segments is preferred.

The transit time is increased by lengthening the segment. This provides a higher effective impedance relative to the leading segment in order to overcome the impedance presented by the speed voltages. It also forces a low segment inclination. The high mutual coupling is attained by bringing the segments closer together. This also increases the number of segments active at a given instant thereby increasing the current partitioning among the active segments.

PRESENT INVENTION RAILGUN CHARACTERIZATION

A characterization of the FIG. 4 and FIG. 6 railgun can be based on the coupled differential equations for projectile motion and electrical circuit behavior with time dependent rail inductance and resistance included. Preferably also included are: (1) the variable inductance and resistance of augmenter rails; (2) simulation of a ripple discharge power supply; and (3) consideration of multiple nested rail segments. Power supply options with and without inductors external to the FIG. 6 barrel are also desirably included; with and without ripple discharge.

While external inductance results in trapped residual magnetic energy, the augmenter rails of the present invention store minimal residual magnetic energy because the active augmenter length is short at projectile launch. The augmenter rails cannot initially store the entire required launch energy however, and therefore require pulsed energy inputs from a power supply during launch.

Figure 14:
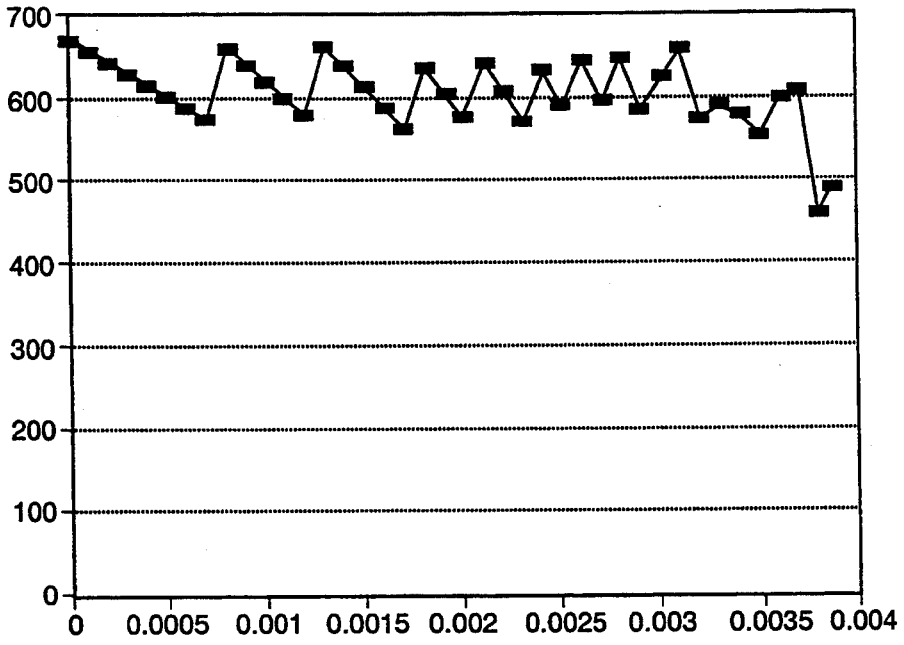
FIG. 14 shows constant railgun current in the presence of rippled discharge of a power supply.
Figure 15:
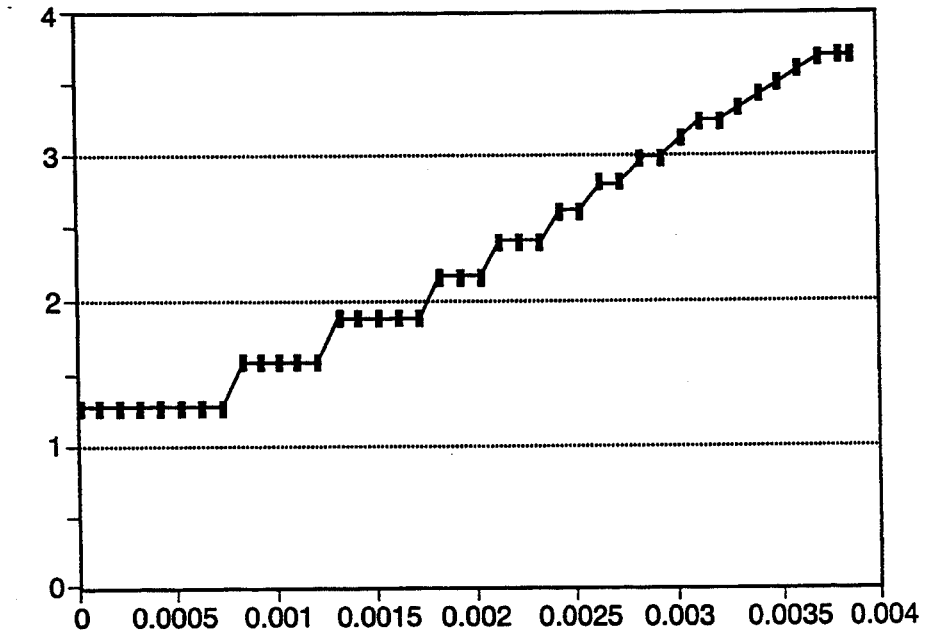
FIG. 15 shows the smaller energy pulses of increased frequency desired in a limited inductance projectile launch.

For the FIG. 4 and FIG. 6 railgun the required gun current-time profile, in kA vs. seconds as shown in FIG. 14 indicates an average current of about 620 kA. Each rise in current (for example, at about 750 μsec) indicates a point where the power supply should provide more energy to the barrel, as quantified in the megajoules vs. seconds relationship shown in FIG. 15. As the launch proceeds the frequency at which the power supply should resupply energy increases and the energy per pulse decreases, because the length of augmenter rail and therefore its inductance decreases with time.

TABLE 2

| CHARACTERIZED FIG. 4 AND 6 RAILGUN PERFORMANCE, PLASMA ARMATURE | |
|---|---|
| Boresize | 50 mm |
| Barrel Length | 11.8 m |
| Effective Inductance Gradient | 0.9 μH/m |
| Rail Segment Length | 0.28 m |
| Effective Coupling Factor | 0.95 |
| Peak Current | 666 kA |
| Projectile Mass | 100 g |
| Muzzle Velocity | 5.92 km/s |

Figure 16:
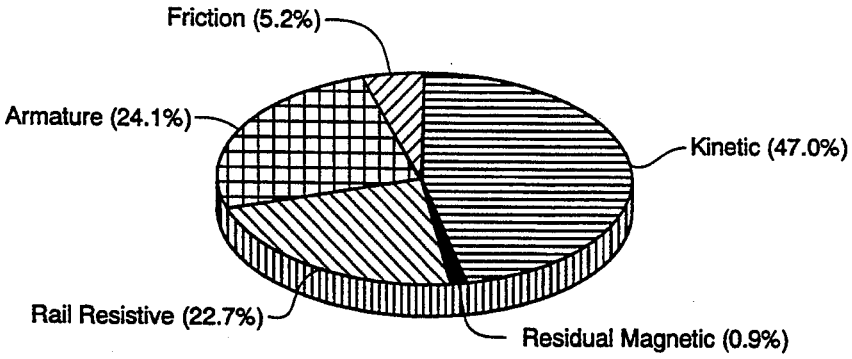
FIG. 16 shows the partitioning of energy in a high efficiency launch.

Partitioning of the energy delivered to the FIG. 4 and FIG. 6 barrel is shown in FIG. 16. The efficiency (i.e., kinetic energy/total energy delivered to barrel) is high for this launch, at 47%, because residual magnetic energy is less than 1% of the total. Rail and armature ohmic losses must be reduced to achieve even higher efficiency. Plasma armature losses in the present invention barrel are essentially the same as a normal railgun, and their reduction is believed only possible with hybrid armatures. The augmenting rails and current crossover bars result in about 30% higher resistive losses than an equivalent simple breach-fed railgun. Larger rails reduce the resistive losses, but at the price of lower intersegment coupling.

EXPERIMENTAL VALIDATION

The physical parameters describing a prototype FIG. 4 and FIG. 6 gun are summarized in Table 3.

TABLE 3

| PROTOTYPE RAILGUN PARAMETERS | |
|---|---|
| Boresize | 15 mm |
| Bore Shape | Square |
| Segment Length | 85 mm |
| Segment Spacing | 11 mm |
| Overall Length | 300 mm |

TABLE 3-continued

| PROTOTYPE RAILGUN PARAMETERS | |
|---|---|
| No. of Simultaneously Active Segments | 7 |
| Segment Conductor Size | 1.6 mm × 9.5 mm |
| Intersegment Insulator Spacing | 0.4 mm |
| Augmentor Rail Size | 12.7 mm × 38.1 mm |

This prototype is 30 cm long with a 15 mm square bore. Type CDA110 half hard copper augmenting and main rail segments are used. The augmenting rails are copper bar 1.27×3.81×30.5 cm. A drawing of the nested main rail is shown in FIG. 17.

Figure 17:
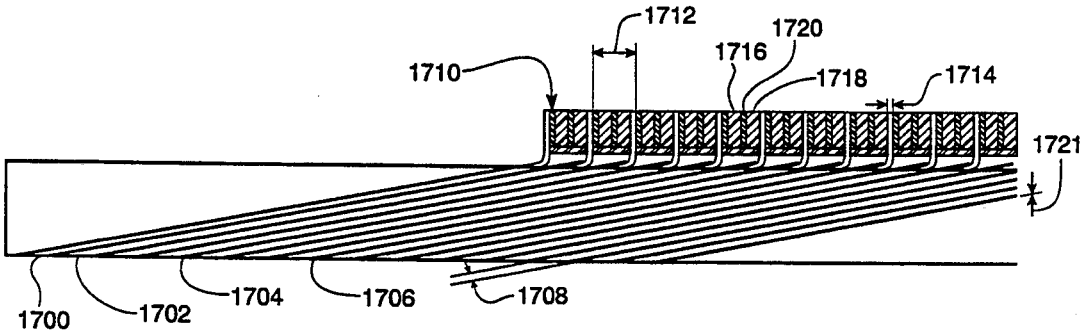
FIG. 17 shows rail segments according to the present invention.

In the FIG. 17 drawing the primary rail segments are shown at 1700 and 1702 for example, in side view form from inside the bore with muzzle at the left end and with the intersegment insulators shown at 1704 and 1706 for example and with the 1.6 mm segment dimension being shown at 1708. The interconnector bars for the FIG. 17 primary rail are indicated at 1710 and 1720 with the 10.8 mm spacing between adjacent interconnector bar pairs being indicated at 1712, the 1.6 mm dimension of an interconnector bar being indicated at 1714, and the insulation between interconnector bars being indicated at 1716 and 1718 for example. The 0.4 mm thickness of the insulation between rail segments is shown at 1721 in FIG. 17.

Figure 18:
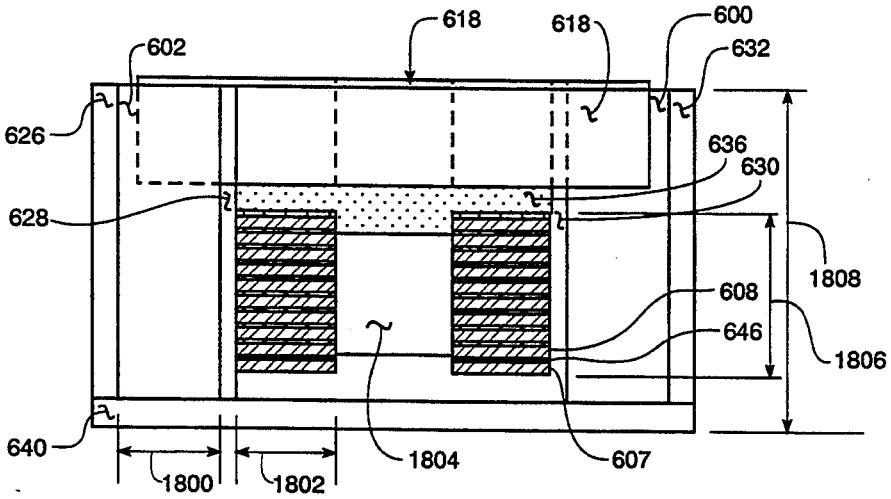
FIG. 18 shows a cross section of a railgun according to the present invention.

Each nested main rail is composed of copper strips 0.16×1.27×11.4 cm separated by strips of G-10 insulator 0.04×1.27×10 cm. These strips were laminated together at a 10 degree angle (with respect to the bore centerline) using a high peel-strength commercial epoxy. Tabs were bent at one end of the copper strips to form a vertical connection for attaching the crossovers. At the 10 degree angle and the 1.08 cm pitch, the rail is designed to have between seven and eight rail segments active at any given time. A wedge of G-10 glass reinforced epoxy glued to the breech end of the rail (right side in FIG. 17) provides a continuous sliding surface to the projectile. The current crossovers are 5.08 cm long strips of equal cross section as the rail segments and are soldered to the rail tabs. The crossovers were located above the bore insulator, and fit into slots machined into the tops of the augmenting rails. FIG. 18 shows a drawing of an assembled core cross-section with selected parts identified by the numbers used in FIG. 6 and with dimensions as shown in Table 4. The Table 4 dimensions are keyed on numbers in the 1800 series.

TABLE 4

| DIMENSIONS FOR FIG. 18 RAILGUN | | |
|---|---|---|
| Identification | Dimensions | Name |
| 1800 | 12.7 mm | augmenting conductor |
| 1802 | 12.7 mm | primary rail segment |
| 1804 | 15 mm × 15 mm | bore |
| 1806 | 17.83 mm | primary rail height |
| 1808 | 42.651 mm | overall height (excluding crossover rails) |

Figure 20:
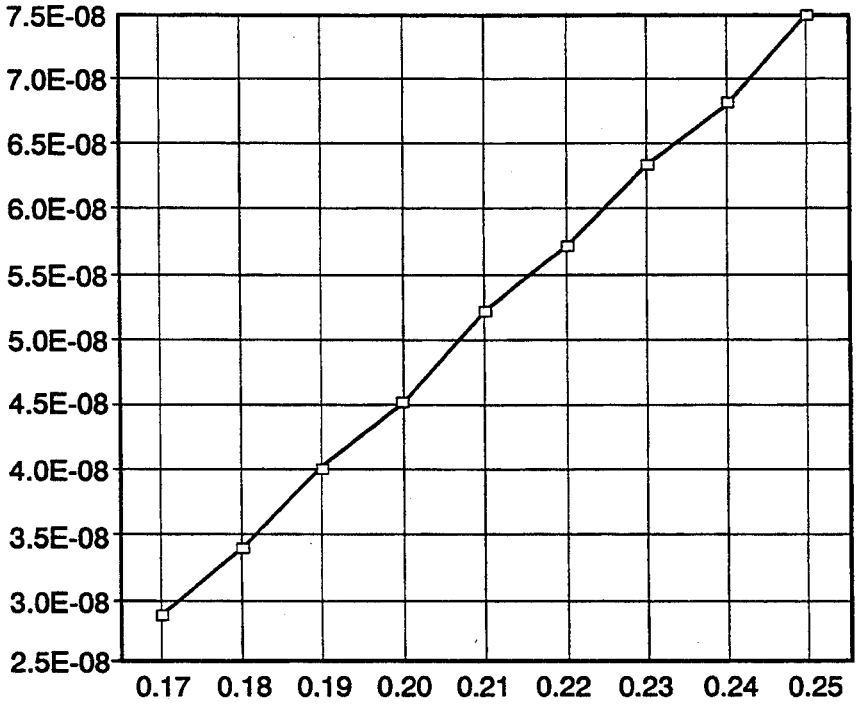
FIG. 20 shows the single segment self inductance for a railgun of the present invention type.

With the muzzle ends of the FIG. 18 augmenting rails connected to a Hewlett Packard model HP 4912A Impedance Analyzer, the inductance measured as a metal armature is moved along the length of the rail is shown on a plot of microhenrys vs centimeter of position from the back end in FIG. 20. A test frequency of 100 kHz is used to simulate the high velocity railgun inductance. This inductance is what a power supply would "see" as the armature accelerates down the bore.

Figure 19:
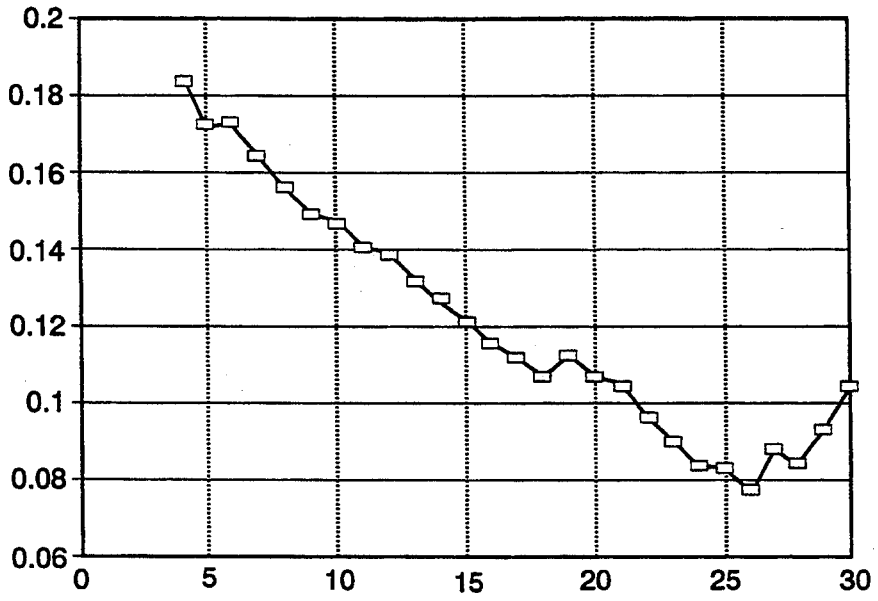
FIG. 19 shows the change in barrel inductance with projectile positioning in a railgun of the present invention type.

FIG. 19 shows the measured total gun inductance versus armature position. The data indicates an inductance gradient of approximately 0.5 H/m which compares well with a computed value of 0.54 H/m for the augmenting rails in the paper published by Kerrisk, J. F. "Current Distribution and Inductance Calculations for Rail-Gun Conductors," LA-9092-MS, Los Alamos National Laboratory, November 1981, which is hereby incorporated by reference herein.

The lack of data points in the first 3 cm of the plot is due to the armature contacting only the G-10 wedge at the breech end of the nested rails. The increase in inductance beginning at 27 cm is due to the armature passing the last connection to the augmenting rails, thereby lengthening the current path instead of shortening it.

The inductance over the length of an individual segment may be measured in two ways: with the augmenting rails connected to the impedance analyzer as in the above test, and with the crossovers connected to the analyzer. In both methods a thin copper leaf mounted on the end of a wooden stick may be used to short two opposing rail segments across the bore in increments along the length of the segment. Both methods yield the same inductance gradient; however as expected, the absolute inductance value of the first test is much higher, owing to the inductance in the augmenting rails. FIG. 20 shows the single segment self inductance in Henrys vs position in meters and indicates an inductance gradient of about 0.56 H/m. The Kerrisk computed segment self inductance gradient is 0.53 H/m.

Mutual inductance measurements require that a pair of opposing rail segments be disconnected from the augmenting rails. This may be accomplished by removing original crossovers and soldering—on shorter crossovers that do not contact the augmenting rails. A sine wave generator may then be attached to the crossovers of the pair of opposing rails on the breech side of the now "open" pair. An oscilloscope may be connected across the "open" pair of rails and across the "powered" pair of rails. By again using copper leaves, each rail may be separately shorted at intervals along the bore, thereby completing two separate voltage loops. The voltage signal produced in the "powered" rails induces a voltage in the "open" rails, and both signals are visible on the oscilloscope. The mutual inductance may then be determined from the equation:

$$\frac{V_{in}}{L_{in}} = \frac{V_{out}}{M_{in,out}} \tag{4}$$

Figure 21:
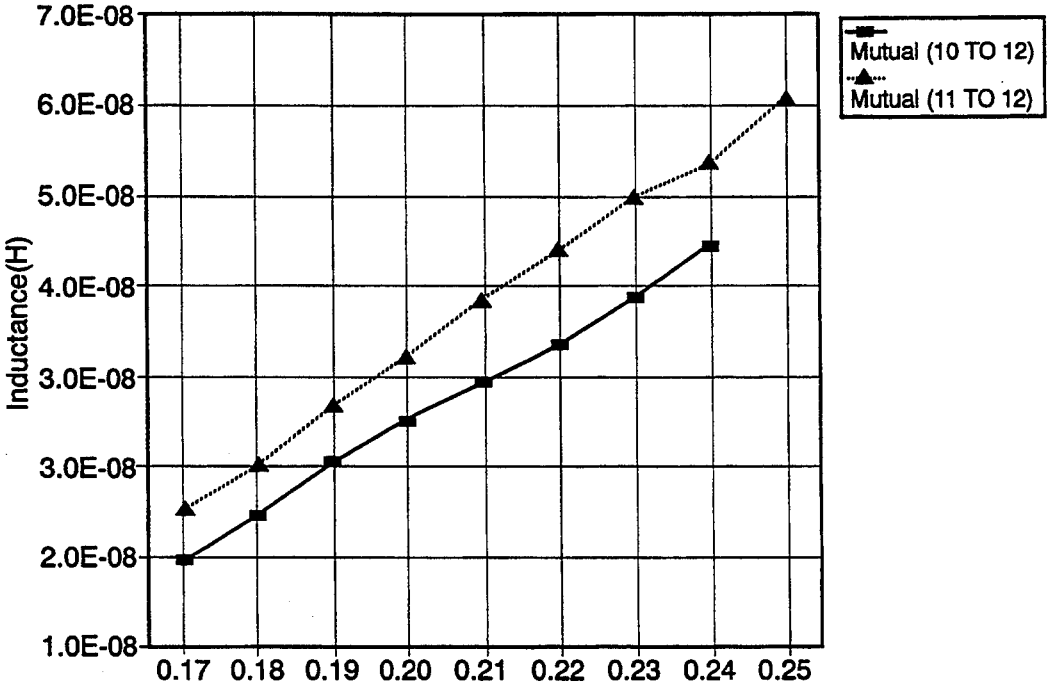
FIG. 21 shows the mutual inductance between differing pairs of the present invention railgun segments.

FIG. 21 shows the mutual inductance for adjacent rail segments and for rail segments separated by one unpowered segment in a plot of Henrys vs. position in meters with the uppermost or triangular dot associated curve representing mutual inductance between adjacent segments 10 and 12 and the lower or rectangular dot curve representing mutual inductance between diametrically opposed segments 11 and 12.

From the known-in-the-art mutual inductance relationship the coupling factor k can be determined as:

$$k = \frac{M_{in,out}}{(L_{in}\,L_{out})^{\frac{1}{2}}} \tag{6}$$

Figure 22:
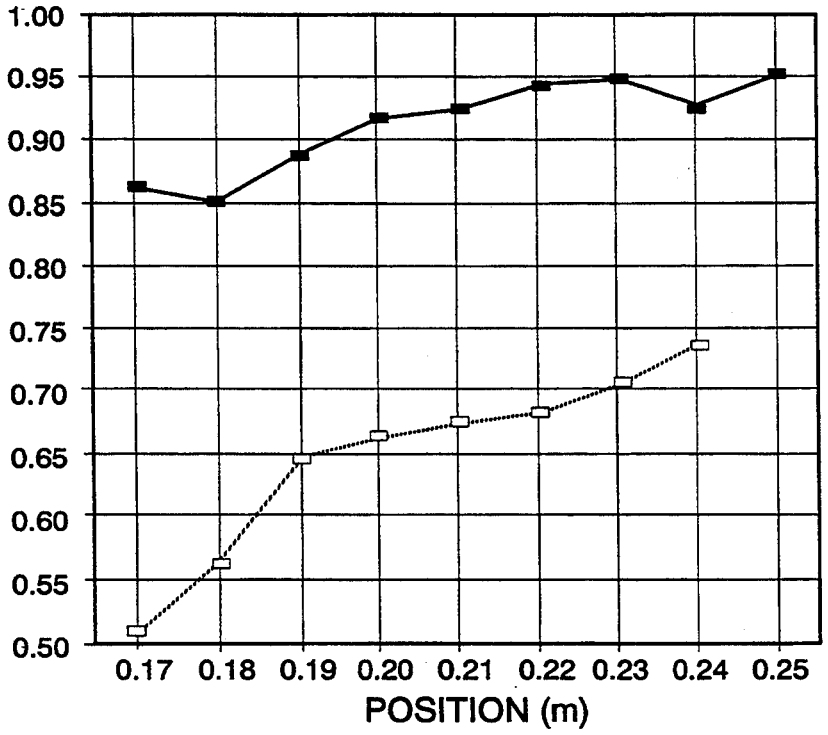
FIG. 22 shows the coefficient of magnetic coupling between pairs of railgun segments.
Figure 23:
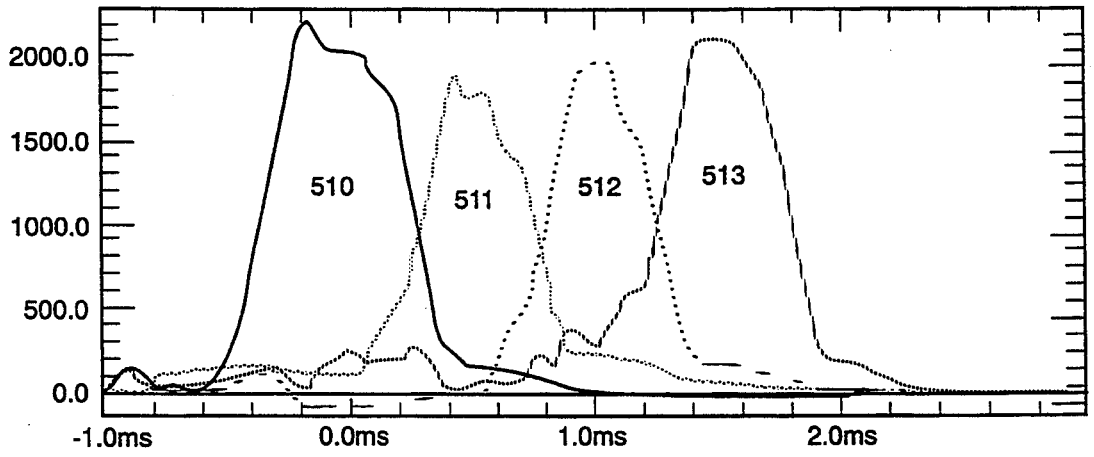
FIG. 23 shows current flow in adjacent segments of a railgun according to the present invention.

The self inductance measurements and the mutual inductance are used to calculate the coupling factor vs. position. Coupling factors may be determined between adjacent rail segments and between rail segments separated by one inactive rail segment. This is shown in the FIG. 22 plot of k vs. position in meters for the diametrically opposed segments 11 and 12, top curve, and the adjacent segments 10 and 12 in the bottom curve. These data show that the disclosed prototype arrangement achieves the high segment coupling required for good performance. Segment currents may also be measured under controlled current and velocity conditions. Here a metal armature is pulled by a pneumatic actuator through the prototype barrel while nearly constant current is supplied via a battery/inductor power supply.

An experimental setup may consist of a battery power supply in series with an inductor and the prototype railgun. The power supply may consist of eight 12-volt car batteries wired in parallel with a nominal maximum output of 5000 amps across a shorted load and an actual test current of about 2000 amps. Approximately 120 feet of 4/0 welding cable wound 30 times around a wooden form may serve as the inductor. The inductor and power supply connect to the railgun via 4/0 welding cable bolted to the muzzle of the augmenting rails.

The metal armature used in these measurements may be of the trailing arm type, made of 7075T6 aluminum, with an overall length of 2.5 cm and a contact patch on each arm of dimensions 3 mm×15 mm. A pneumatic piston assembly may be used to pull the armature along the bore via a G-10 material rod preferably with a velocity of 20 m/s. Rogowski coils, muzzle and breech voltage leads, and B-dot loops are preferably included to accomplish individual rail segment measurements. Four Rogowski coils each about 10 cm in length and 0.3 cm in diameter, with a sensitivity of approximately $20\times10^{-9}$ V*s/A are preferably used. These sensors are wrapped around the crossover bars connected to four consecutive rail segments. The instrumented segments are preferably located in the middle of the main rail and chosen to find a steady-state response. A fifth Rogowski coil with a sensitivity of $11.05\times10^{-9}$ V*s/A may be used to measure the total current supplied by the battery cart.

The Rogowski coil outputs may be amplified by a set of Dynamics corporation model 7514B differential DC amplifiers with gains of 100 used on the crossover currents, and a gain of 200 used on the total current. These amplified voltages are then passed through standard hybrid integrators to digital data recorders.

Preferably a total of eight rail-to-rail voltages are measured, four from breech-to-breech and four muzzle-to-muzzle voltages. The voltage measurement leads are preferably placed upon the same rails that the crossover currents are measured in. The breech-to-breech voltages are remeasured as the voltage from the "tab" of one rail segment to the tab of its counterpart directly across the bore from it. Similarly, muzzle voltages are preferably read from the bottom of one rail segment (where it butts against the lower bore insulator) to the same place on its counterpart across the bore. All voltage lead loops are completed with a 10 ohm resistor and passed through a Pearson coil to isolate the leads from the recording instrumentation.

The five B-dot loops are preferably placed 5 cm apart from each other in the lower bore insulator. Each loop consists of 10 turns of wire and has an average diameter of 7 mm. The probes primarily provide position information.

Figure 24:
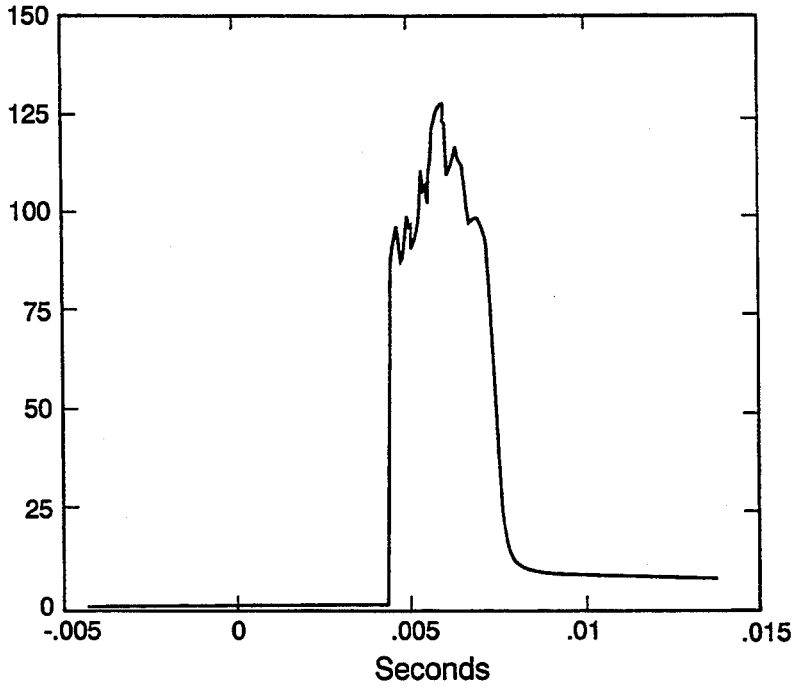
FIG. 24 shows segment to segment current transfer without arcing in a railgun according to the present invention.

Individual segment current data are shown in FIG. 24 in a plot of amperes vs. milliseconds for the four consecutive segments; segments 10–13, instrumented with Rogowski coils. These data show that all four segments are active as expected. These data also show that essentially each segment carries most of the current consecutively. For example, during the period from about 0.0 to 0.7 ms the second (instrumented) segment carries a substantial fraction of the total current. At about 0.6 ms, when the third segment becomes active, the current in the second segment drops rapidly. The segment current almost returns to zero by the time the armature reaches about 50% to 60% of the segment length. The impedance through the other segments is apparently much smaller by this point. The same trends appear for the 100 m/s case shown in the FIG. 10 plot of main rail arc voltage vs. seconds.

The voltage lead records for this test show that at 4.392 ms the armature left the main rails, resulting in an 100 V arc, as shown in FIG. 24. Prior to exit the armature voltage is only 1 to 2 volts. Examination of the voltage records prior to armature exit shows a nearly constant voltage. This lack of voltage spikes indicates that no arcs occurr during the time in which the armature is in the bore. These data clearly confirm that there is segment current flow when the armature moves off the segment.

CONCLUSIONS

The analytical and experimental results described herein demonstrate the feasibility of the present invention railgun configuration. The results show that with high mutual coupling, current will transfer between segments without destructive arcs or high energy dissipation. In fact, the present invention railgun will be efficient because minimal residual magnetic energy storage exists at the end of a launch event.

The combination of the present invention therefore provides an improved railgun in which a single energy source or power supply may be used with nested and segmented primary rails and in combination with augmenting rails. The augmenting rails in addition provide the electrical inductance necessary for energy storage during a projectile launch event. By way of the combination of argumenting rail inductance energy storage, pulsed power supply energy, and resistive plus inductive current commutation between rail segments, the railgun of the present invention is capable of achieving high efficiency hypervelocity operation that overcomes limitations encountered in previous railgun arrangements. The simplicity and reduced size of the inductor-free single energy source present invention railgun is believed to more closely approach the needs of a practical apparatus than the heretofore arranged railgun systems.

While the apparatus and method herein described constitute a preferred embodiment of the invention, it is to be understood that the invention is not limited to this precise form of apparatus or method and that changes may be made therein without departing from the scope of the invention which is defined in the appended claims.

I claim:

1. Single energy source augmented rail gun apparatus comprising the combination of:

first and second nested arrays of projectile guiding projectile accelerating, electrically conductive, primary rail segments disposed in diametric opposition along a central axis of said apparatus and defining a gun barrel portion thereof, with each segment of each said array residing in both a first plane of parallel disposition with said central axis and in an orthogonal second plane of oblique angle disposition with said central axis, and with each segment of each said array also being electrically isolated, but magnetically coupled with substantially adjacent additional segments of said arrays;

a plurality of electrically conductive augumenting rail members each disposed lengthwise parallel of said central axis and adjacent an external surface of a primary rail segment nested array in electrical isolation and magnetic coupling therewith;

a plurality of primary rail segment to augmentation rail electrical interconnection bar members crosswise disposed along said central axis in physical displacement therefrom and interconnecting an electrical input terminal end portion of each rail segment with an opposite augmentation rail member;

with each combination of a primary rail segment, an interconnection bar member, and an augmenting rail member portion also comprising electrical energy storing electrical inductance means, equivalent with an external discrete electrical inductance member, for storing projectile acceleration energy in electrical form;

a movable ballistic projectile member initially disposed between breach end boundaries of said first and second primary rail segments and movable along said primary rail segments and said central axis in response to electrical energy current flow in said augmenting rail members and multiple segment successions of said primary rail segments; and single output port electrical energy sourcing means selectably connected between gun barrel muzzle terminal ends of said augmenting rail members for generating magnetically linked electrical currents responsive to gun barrel positioning of said projectile member in said primary rail segments and in said augmentation rail members.

2. The apparatus of claim 1 further including metallic support means lengthwise disposed along said central axis in electrical isolation with said rail segments and said augmentation rail members for maintaining predetermined physical dimensions in said apparatus during energized use thereof.

3. The apparatus of claim 1 wherein said single output port electrical energy sourcing means includes pulsed energy sourcing means for supplying repeated pulses of electrical energy to said augmenting rail members.

4. The apparatus of claim 1 wherein said projectile member includes electrical isolation means for excluding said electrical currents therefrom and plasma resisting means for withstanding the temperatures and pressures of a projectile accelerating electrical arc.

5. The apparatus of claim 1 wherein said augmenting rail members are of substantially larger cross-sectional area than each segment of said primary rail segment.

6. The apparatus of claim 1 wherein said second plane is disposed at an oblique angle of between 0 and 40 degrees with respect to said central axis.

7. The apparatus of claim 1 wherein each of said nested array primary rail segments is of chevron configuration and includes a portion located in a third plane that is orthogonally disposed of said first plane and obliquely disposed of said second plane.

8. The apparatus of claim 1 wherein said disposed interconnection bar members are disposed in pairs along said central axis with one member of each pair being connected to an oppositely disposed augmenting rail member.

9. The apparatus of claim 1 wherein said electrical energy sourcing means includes projectile position and velocity responsive energy pulsing means for adding successive pulses of electrical energy to an accelerating projectile being launched therefrom.

* * * * *